US005307527A

United States Patent [19]

Schober

[11] Patent Number: 5,307,527

[45] Date of Patent: May 3, 1994

[54] POOL CHAIR

[76] Inventor: Thomas Schober, 886 South Ponderosa St., Orange, Calif. 92666

[21] Appl. No.: 974,808

[22] Filed: Nov. 12, 1992

[51] Int. Cl.[5] ..... E04H 4/14; A47K 3/12

[52] U.S. Cl. ..... 4/496; 4/579; 297/254

[58] Field of Search ..... 4/494, 496, 578.1, 579; 297/14, 254, 255, 256

[56] References Cited

U.S. PATENT DOCUMENTS 3,690,525 9/1972 Koons ..... 297/254 X 4,837,869 6/1989 Simmon ..... 4/496

4,893,363 1/1990 Huff ..... 4/496

*Primary Examiner*—Robert M. Fetsuga

[57] ABSTRACT

Disclosed is a pool chair 10 adapted to be partially submerged in water in a swimming pool 11. It includes a frame 12 having a seat 72 and an upper cross member 22 adapted to rest along the perimeter 11a of the pool 11 to hold the pool chair 10 upright in the pool in a stationary position which enables a user to sit on the seat with the user's lower torso and legs submerged in the water and the user's head above the water.

3 Claims, 2 Drawing Sheets

POOL CHAIR

BACKGROUND OF THE INVENTION

1. Field of the Invention

This invention relates to a pool chair adapted to be submerged in an upright, stationary position along the perimeter of a swimming pool, allowing the user to sit in the chair with his or her body partially submerged in the pool water.

2. Background Discussion

There are a wide variety of pool accessories available. Some of these are floating devices which allow an individual to sit in the device and float with his or her body partially submerged in the water. Many swimmers, however, would prefer to sit in a more upright position similar to that of a conventional chair. This would allow the individual to have most of his body in the water, but the head above the water surface.

SUMMARY OF THE INVENTION

It is the objective of this invention to provide a pool chair which may be suspended from the edge of the pool and maintained in a generally upright position.

Briefly, the pool chair of this invention is adapted to be partially submerged in water in a swimming pool. It includes a frame made of a plurality of tubular members connected together. The frame has a back rest, a seat, and an upper and lower cross members. The upper cross member is adapted to rest along the perimeter of the pool to hold the pool chair upright in the pool in a stationary position which permits a user to sit on the seat with the user's lower torso and legs submerged in the water and the user's had above the water. The lower cross member is below the seat, and is connected to the back rest to bear against a sidewall of the pool when the pool chair is placed in the water and the user sits on the chair.

The pool chair of this invention has several features, no single one of which is solely responsible for its desirable attributes. Without limiting the scope of this invention as expressed by the claims which follow, the prominent features are discussed in the section entitled, "DESCRIPTION OF THE PREFERRED EMBODIMENT." After reading this section, one will understand how the features of this invention provide its advantages, which include low cost construction, ease of assembly, convenience and simplicity of use.

BRIEF DESCRIPTION OF THE DRAWING

The preferred embodiment of this invention, illustrating all its features, will now be discussed in detail. This embodiment depicts the novel and non-obvious pool chair of this invention shown in the accompanying drawing, which is for illustrative purposes only. This drawing includes the following figures (Figs.), with like numerals indicating like parts.

DESCRIPTION OF THE PREFERRED EMBODIMENT

Figure 4:
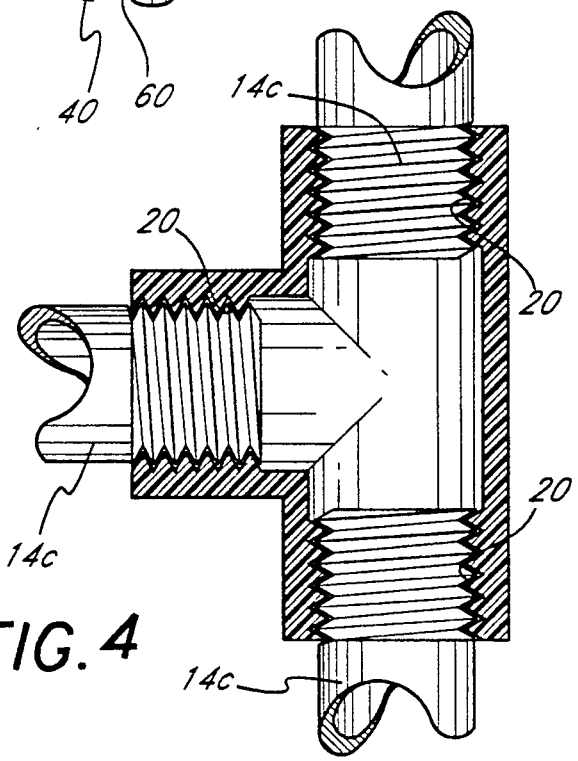
FIG. 4 is a cross-sectional view taken along line 4—4 of FIG. 1.
Figure 3:
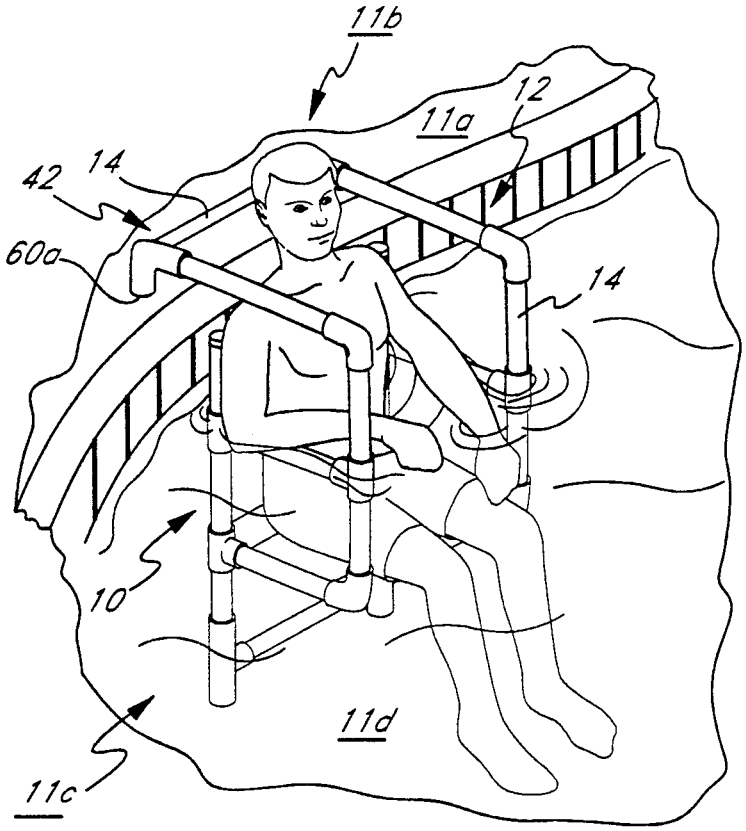
FIG. 3 is a perspective view of an individual using the pool chair of this invention.

As depicted in FIG. 3, the pool chair 10 of this invention is adapted to be partially submerged in a swimming pool 11, with the chair hanging from the perimeter 11*a* of the pool. This chair 10 includes a frame 12 made of tubular elements 14 connected together by elbows 16 and T-joints 18. The tubular elements 14, elbows 16, and T-joints 18 preferably are made of PVC. As shown in FIG. 4, the ends 14*c* of the tubular elements 14 are threaded, and the internal surfaces 20 of the elbows 16 and T-joints 18 are threaded to allow the frame 12 to be easily assembled or disassembled.

Figure 1:
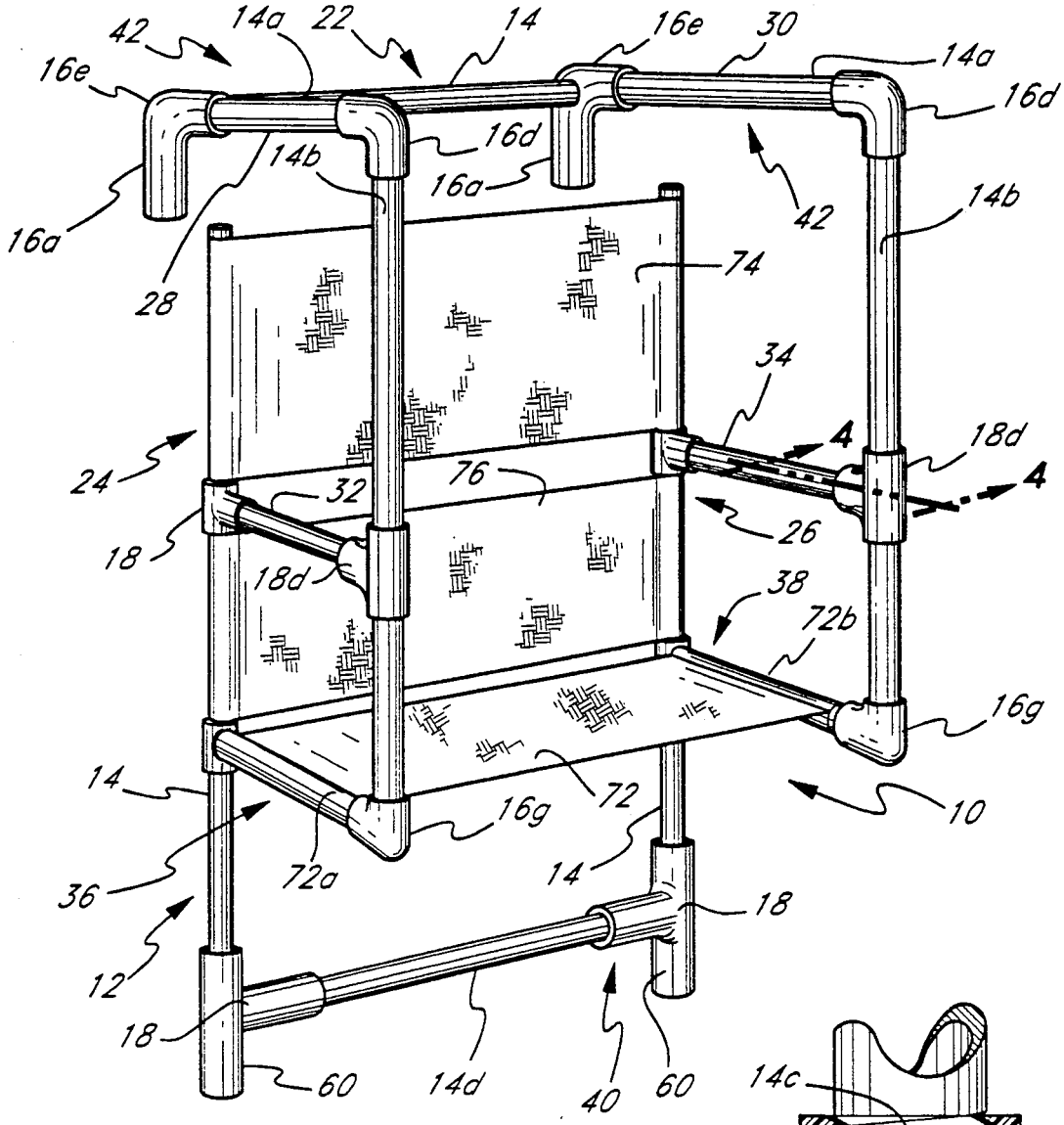
FIG. 1 is a perspective view of the pool chair of this invention.

The frame 12 includes an upper cross member 22, a pair of back braces 24 and 26, a pair of side bars 28 and 30, a pair of arm members 32 and 34, a pair of seat bars 36 and 38, and a lower cross member 40 (FIG. 1). Each side bar 28 and 30 has a top tubular element 14*a* and a front tubular element 14*b* connected together by the elbows 16*d* to form substantially right angle. The lower ends of the front tubular elements 14*b* are connected to the T-joints 18*d*. Connected between the T-joints 18*d* and lower elbows 16*g* are the tubular elements 70. The ends of the side bars 28 and 30 overlapping the perimeter 11*a* of the pool 11 are connected to side outlet elbows 16*e*, with the upper cross member 22 connected between these same side outlet elbows 16*e*. The downward pointing ends 16*a* of the side outlet elbows 16*e* rest against the top surface 11*b* of the perimeter 11*a* of the pool 11, and intermediate portions 42 of the top elements 14*a* bear against the rim 11*c* of the pool 11.

Figure 2:
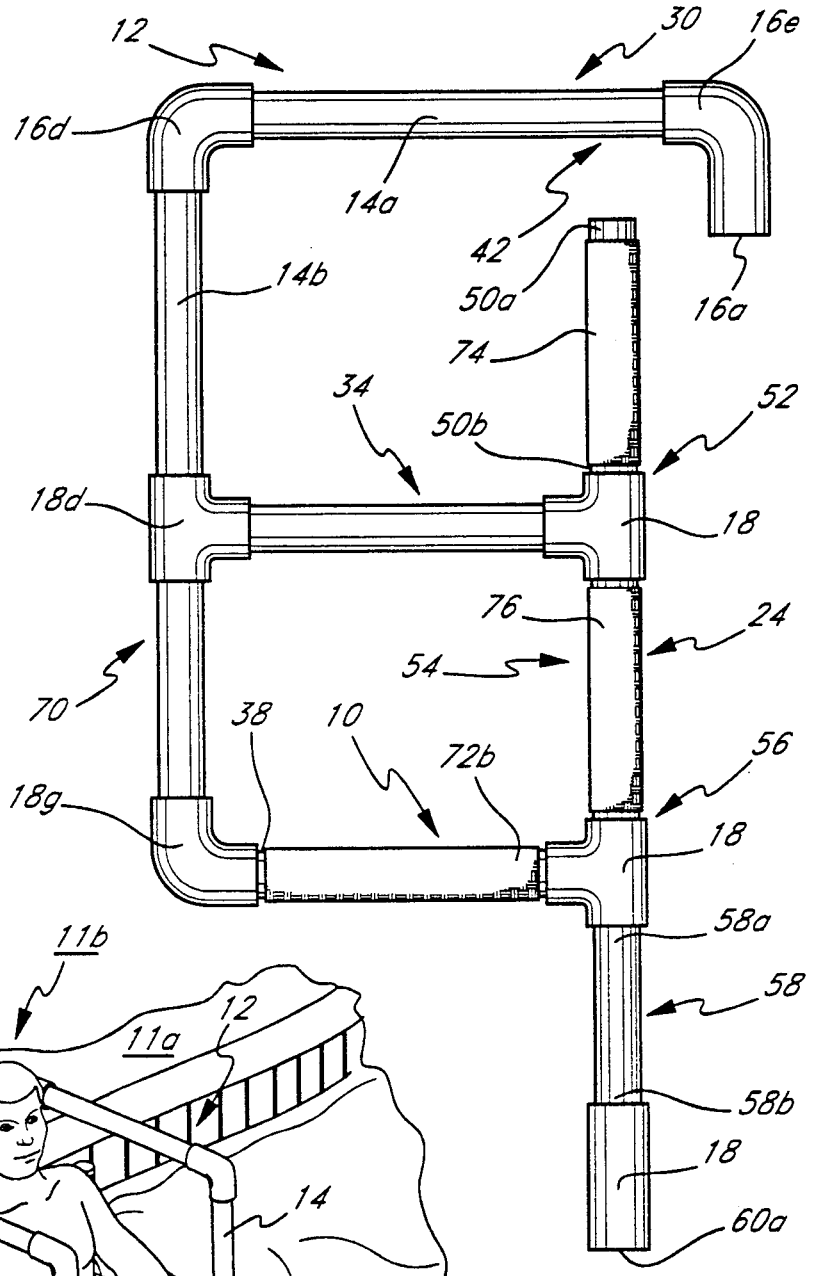
FIG. 2 is a side elevational view of the pool chair of this invention.

As best shown in FIG. 2, each back brace 24 and 26 includes three tubular elements: a top element 50 having free upper end 50*a* and a lower end 50*b* connected to the T-joint 52, an intermediate element 54 connected between the T-joints 52 and 56, and a lower tubular element 58 connected at an upper end 58*a* to the T-joint 56 and connected at a lower end 58*b* to the T-joint 60. The two bottom T-joints 60 are connected together by the tubular element 14*d* to form the lower cross member 40. Each T-joint 60 is open at its lower end 60*a* to allow water to flow into the back braces 24 and 26, filling the tubular members 50, 54, and 58 with water. This causes the chair to rest against the side wall 11*d* of the pool 11 in an upright position.

Connected between the T-joints 52 and 18*d* are the arm members 32 and 34. Connected between the elbows 16*g* and the T-joints 56 are the seat bars 36 and 38. A fabric seat 72 having looped end sections 72*a* and 72*b* is attached to the chair 10 by passing the seat bars 36 and 38 through the looped end sections. In a similar manner, two spaced apart fabric backs 74 and 76 with looped end sections along their outer edges are carried by, respectively, the tubular elements 50 and 54 which extend through the looped end sections. Suitable fabrics for the seat 72 and backs 74 and 76 are, for example, canvas, nylon, or a plastic material such as vinyl. To facilitate replacement of worn fabric, the looped end sections, instead of being sewn, are formed using a hook and fabric type connector such ones sold under the trademark VELCRO®.

To use the pool chair 10 of this invention, one simply places the chair into the pool 11 with the upper cross member 22 extending along the perimeter 11*a* of the pool and the ends 16*a* of the side outlet elbows 16*e* resting on the surface 11*b* of the perimeter. The user lowers himself or herself onto the seat 72. The chair 10 rests against the side wall 11*d* of the pool 11, with the back braces 24 and 26 pressing against the side wall. The lower cross member 40 and lower tubular elements 58 provide both additional support and rigidity to the frame 12 and also assists in forcing the chair 10 against the side wall 11*d* of the pool 11, so that the chair is in a generally upright position with the user seated on the seat 72. The user's body is only partially submerged in the water, with his or her lower torso and legs completely submerged in the water and the head above the water.

The tubular elements 14, elbows 16, side outlet elbows 16*e*, and T-joints 18 need not be threaded, but may be simply fitted together and an adhesive applied at the points of contact to bond these elements so that they cannot be disconnected.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed.

On the contrary, the intention is to cover all modifications and alternate constructions coming within the spirit and scope of the invention as generally expressed by the following claims, which particularly point out and distinctly claim the subject matter of the invention:

1. A pool chair adapted to be partially submerged in water in a swimming pool, including a frame made of a plurality of tubular members connected together to form an upper cross member adapted to rest along the perimeter of the pool to hold the pool chair upright in the pool in a stationary position which enables a user to sit in the chair with the user's lower torso and legs submerged in the water and the user's head above the water, a pair of L-shaped side bars spaced apart to permit a user's upper torso to fit comfortably between said side bars, each side bar having a front element and a top element forming a right angle, said top element having one end connected to the cross member and another end connected to the front element, a back section including a pair of back braces which bear against a side wall of the pool when the chair is submerged, each back brace having opposed lower and upper ends, a pair of arm members, each arm member being connected between a first intermediate portion of one of said back braces and an intermediate portion of one of the front elements, said arm members being disposed generally at a right angle to said one back brace and said one front element, a pair of seat bars, each seat bar having an end connected to a second intermediate portion of said one back brace below said first intermediate portion and another end connected to the front element, a lower cross member connected between the lower ends of the back braces, a seat extending between said seat bars, and a back extending between said back braces.

2. The pool chair of claim 1 where the tubular members have threaded connector segments which allow said tubular members to be connected and disconnected.

3. The pool chair of claim 1 where the lower end of each back brace is open to allow water to enter the tubular member form said back

* * * * *